US005580066A

United States Patent [19]

Jairam

[11] Patent Number: 5,580,066

[45] Date of Patent: Dec. 3, 1996

[54] CARTRIDGE STAPLER WITH JAM RESISTANT MECHANISM

[75] Inventor: Sarwan A. Jairam, Richmond Hill, N.Y.

[73] Assignee: Acco USA, Inc., Wheeling, Ill.

[21] Appl. No.: 224,351

[22] Filed: Apr. 7, 1994

[51] Int. Cl.[6] ..... B25C 1/02

[52] U.S. Cl. ..... 227/123; 227/120; 227/137

[58] Field of Search ..... 227/123, 121, 227/120, 137, 147

[56] References Cited

U.S. PATENT DOCUMENTS

| | | | |
|---|---|---|---|
| 3,524,575 | 8/1970 | Hurkmans et al. | 227/123 |
| 4,139,137 | 2/1979 | Gupta | 277/123 |
| 4,200,215 | 4/1980 | Novak et al. . | |
| 4,549,681 | 10/1985 | Yamamoto et al. | 227/123 |
| 4,588,121 | 5/1986 | Olesen | 277/120 |
| 4,770,334 | 9/1988 | Hoshi et al. | 277/120 |
| 4,913,332 | 4/1990 | Olesen . | |
| 4,978,045 | 12/1990 | Murakami et al. | 227/120 |
| 5,121,868 | 6/1992 | Jairam | 227/123 |

FOREIGN PATENT DOCUMENTS

| | | |
|---|---|---|
| 1478934 | 4/1969 | Denmark . |
| 0446055 | 9/1991 | European Pat. Off. . |
| 0510351 | 10/1992 | European Pat. Off. . |

*Primary Examiner*—Rinaldi I. Rada
*Assistant Examiner*—Allan M. Schrock
*Attorney, Agent, or Firm*—Pennie & Edmonds

[57] ABSTRACT

A cartridge stapler having a head, a driver blade and a sheath in which the sheath is controlled by configured sheath holes, head slots and selective positioning of the cartridge. Cartridge insertion stabilizes the sheath during normal operation to reduce jamming and upon its removal allowed for sheath movement to clear a jam.

5 Claims, 5 Drawing Sheets

CARTRIDGE STAPLER WITH JAM RESISTANT MECHANISM

The present invention relates generally to staplers and, more particularly, to cartridge-type staplers.

BACKGROUND OF THE INVENTION

Prior arrangements for controlling a wraparound sheath for a cartridge stapler have included harness means for urging the cartridge and sheath against one another (U.S. Pat. No. 5,121,868 to Jairam) and rotatable disks in the sheath sides controlled by spring arms (U.S. Pat. No. 4,913, 332 to Olesen). In another proposal the wraparound sheath or front jaw is releasably connected to side pins (U.S. Pat. No. 4,200,215).

None of these proposals have been fully satisfactory in all applications.

SUMMARY OF THE INVENTION

Broadly, the present invention comprises a manual or powered stapler with a pivotal head having an improved sheath which sheath is pivotal about an upper axle while capable of being held stationary to reduce jamming by controlling a lower sheath axle during stapling which lower sheath axle is releasable after such operation to unclear any jam which may occur.

It is a feature that the lower axle may be held in a fixed normal operating position by the cartridge and head slot wall and upon removal of the cartridge the lower axle is free to move in such slot permitting sheath rotation to unjam the stapler.

DESCRIPTION OF THE PREFERRED EMBODIMENT

Figure 1:
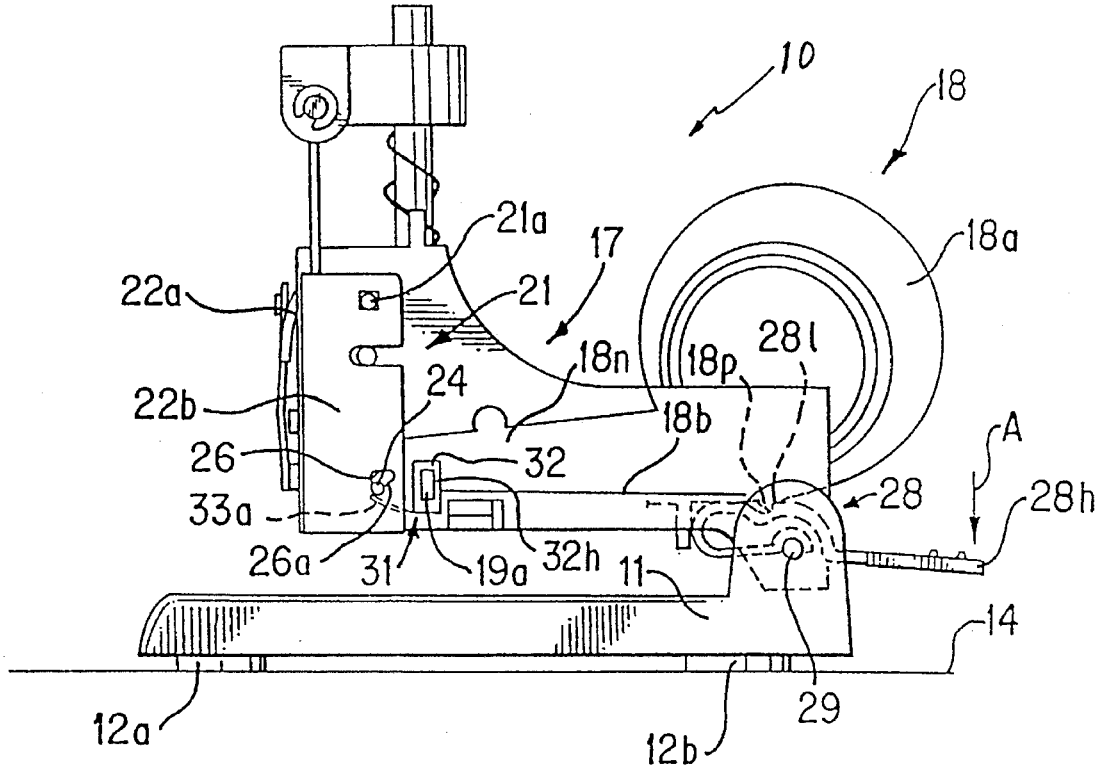
FIG. 1 is a side elevational view of a manual cartridge stapler of the present invention.
Figure 1A:
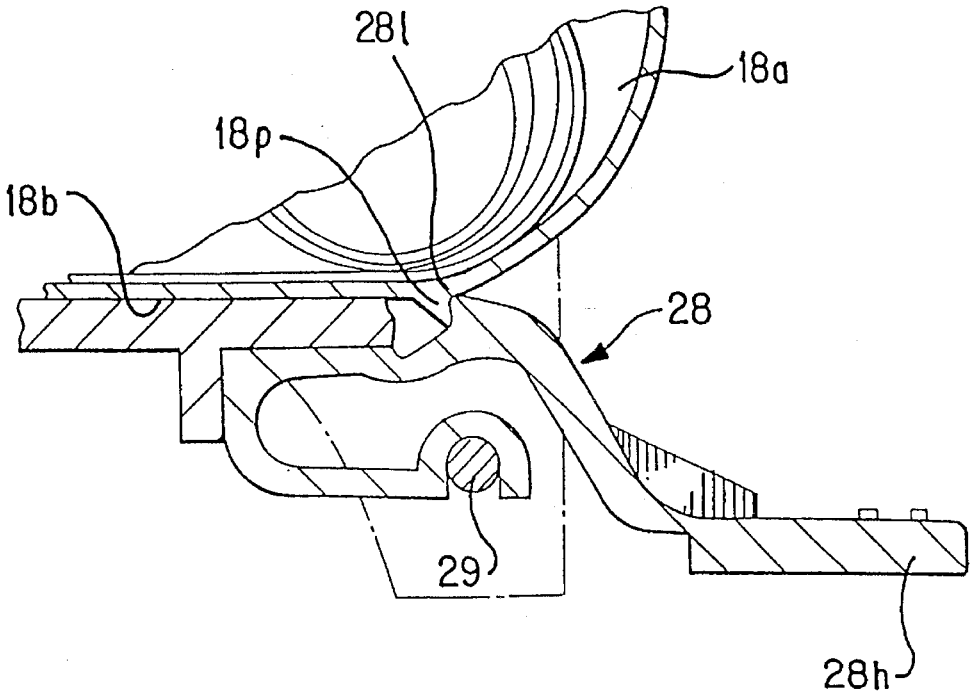
FIG. 1*a* is an enlarged partial side elevational view of the stapler showing cartridge engagement.

In the FIGS. 1 and 1*a*, manual stapler 10 (with hand knob removed) includes base frame 11 with feet 12*a, b* positioned on support surface 14. Pivotally mounted on frame 11 about base-to-head axle 29 is swingable head 17 including staple blank cartridge unit 18 having a blank staple coil housing portion 18*a*, nose head portion 18*n* and bottom surface 18*b*. Sheath 21, pivotal about upper sheath axis rod 21*a*, includes a front panel 22*a* and side panels 22*b* and *c*. The position of sheath 21 is determined by upper axle rod 21*a* and lower cross pin axle 24 having ends extending out of sheath 21's configured hole 26 in left sheath panel sides 22*b* and similarly configured hole in right sheath panel side 22*c* (not shown). Configured holes are shaped so that when cartridge 18 is installed cross axle 24 is moved downward and held in the lowest areas 26*a* of panel holes 26 (see also FIG. 5). This arrangement holds sheath 21 in a firm stationary and rigid position during normal stapling operations. Also shown in FIG. 1 is resilient cartridge release lever 28 pivotally mounted on base-to-head axis 29. Lever 28 has ledge 28*l* which engages cartridge lower ridge piece 18*p* to hold cartridge 18 in operating position. When handle portion 28*h* of lever 28 is depressed (arrow A) lever 28 flexes to allow ledge 281 to clear cartridge ridge piece 18*p* permitting cartridge 18 to be withdrawn.

Figure 2:
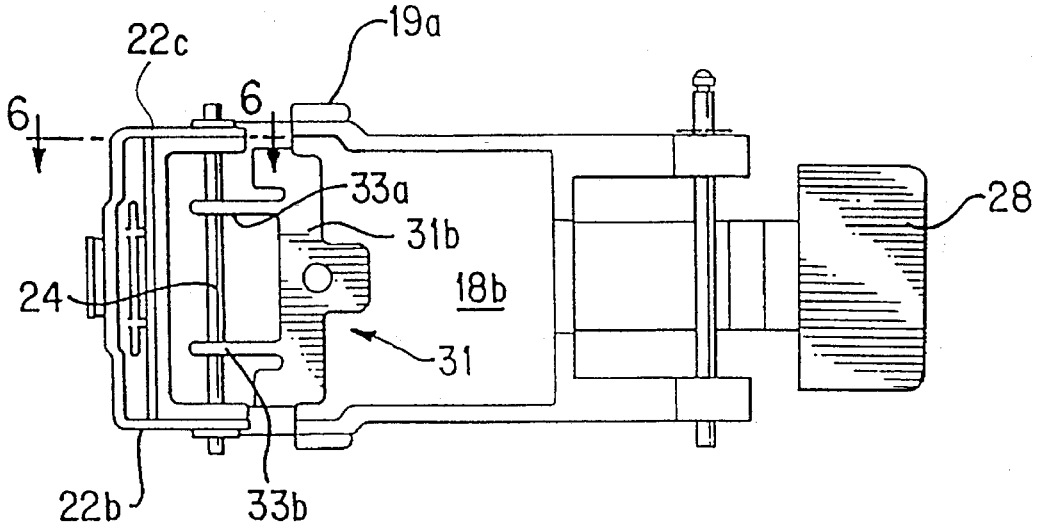
FIG. 2 is a bottom view of the stapler.
Figure 3:
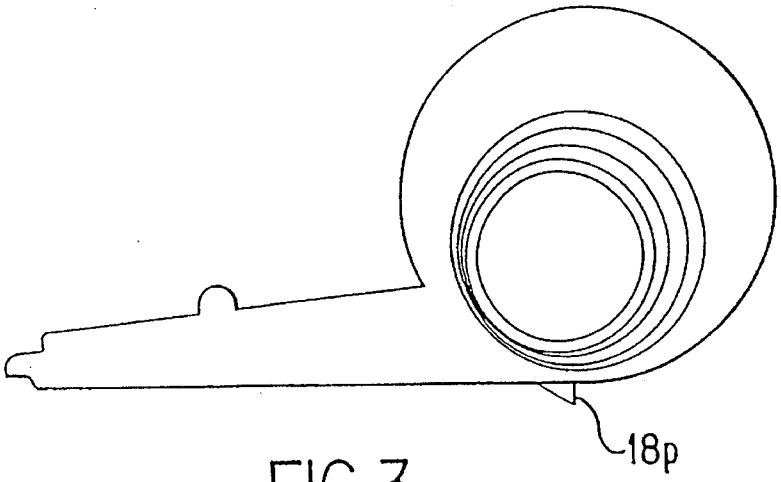
FIG. 3 is a side elevational view of the cartridge.
Figure 4A:
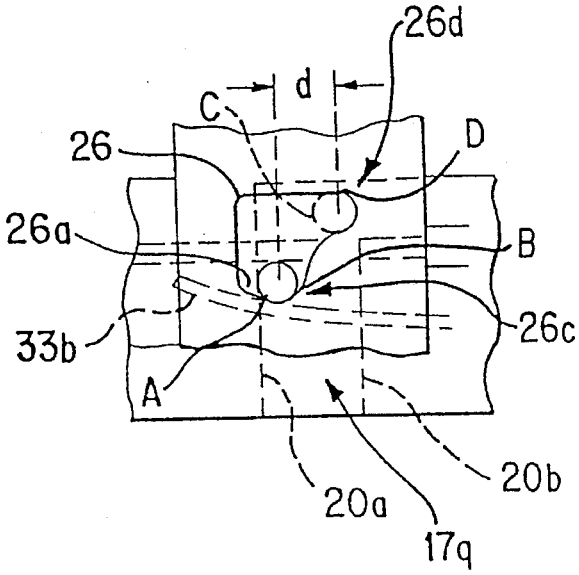
FIG. 4*a* is an enlarged partial view of FIG. 4 including a head slot.
Figure 4:
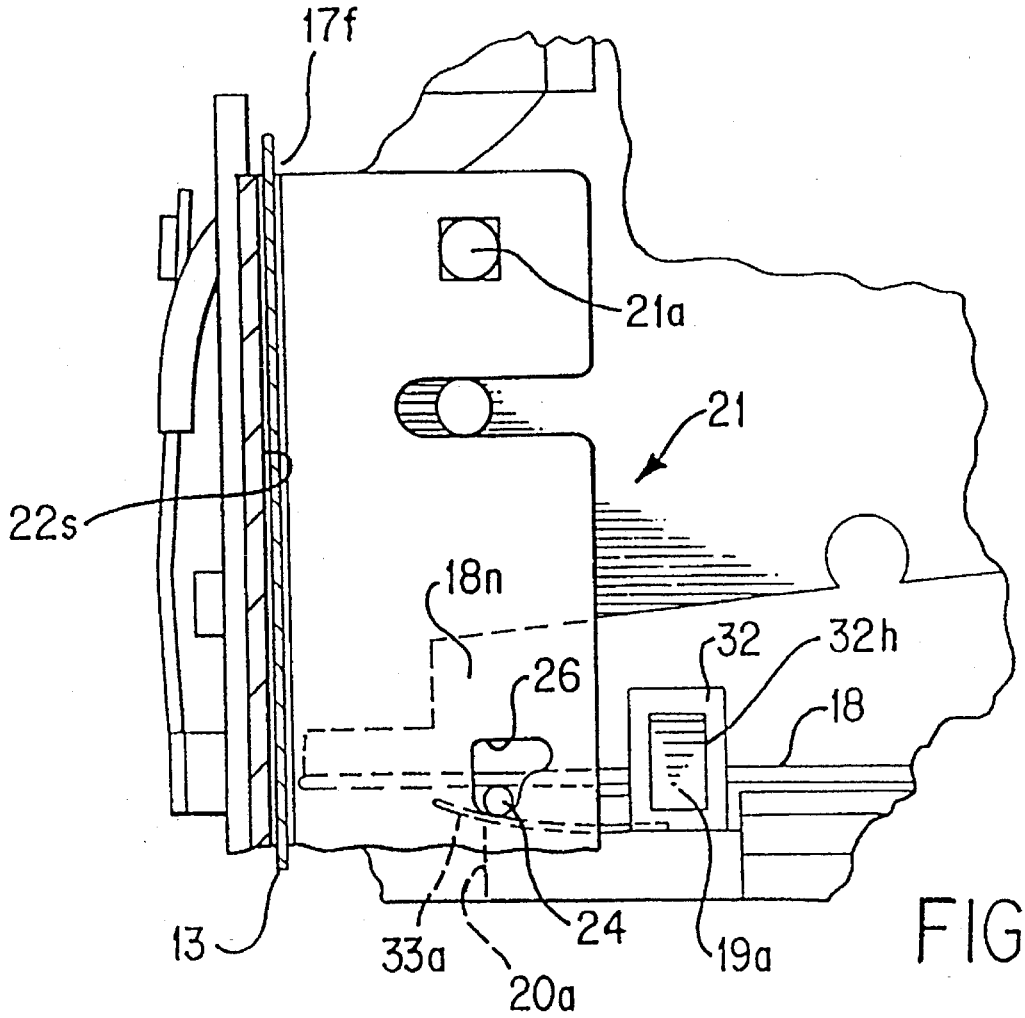
FIG. 4 is a partial side elevational view showing the sheath, lower cross axle, base spring and cartridge nose.
Figure 5:
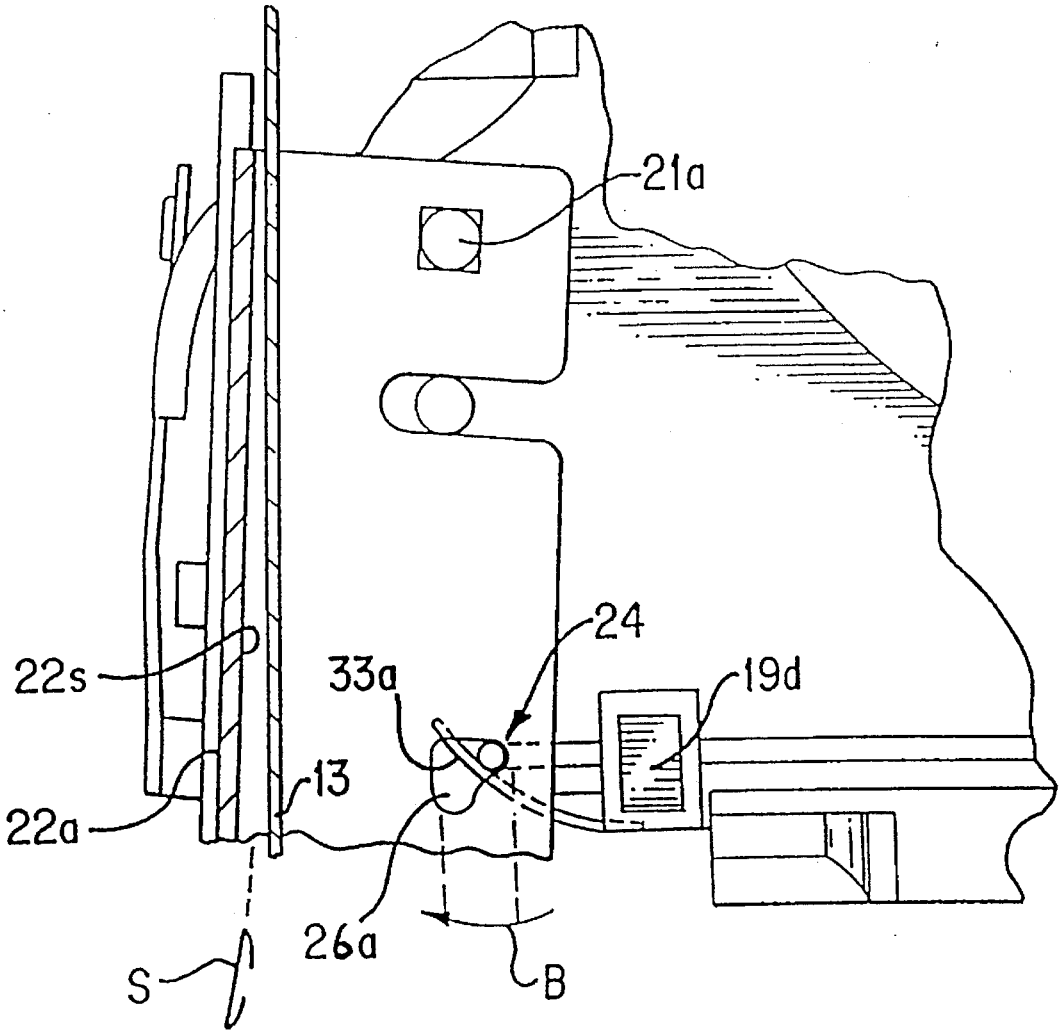
FIG. 5 is a view similar to FIG. 4 with the cartridge nose removed to release the sheath.

Turning to FIGS. 2, 4 and 4*a*, spring 31 includes upright spring ends 32 having holes 32*h* which fit over head rectangular left protrusion 19*a* and right protrusion (not shown). Spring 31 is held in a fixed position. Spring 31 has body portion 31*b* and two (2) curved spring fingers 33*a*, 33*b* which bias cross pin axle 24 upwardly and when cartridge 18 is removed, raise cross pin axle 24 as permitted by the limits of configured sheath panel holes 26 (FIG. 5). Sheath upper axle rod 21*a* is housed firmly in a cross passageway (not shown) in head 17. When cartridge 18 is installed in stapler head 17 the cartridge bottom 18*b* pushes pin axle 24 down and holds it down in sheath hole areas 26*a* and against forward walls 20*a* of each head slot 17*g* (see FIG. 4*a*). As shown in FIG. 4*a*, area 26*a* has rearward curved arcuate portion 26*c* which has a curvature from point A to point B equal to the curvature of pin axle 24. Both curvatures are generated about radii of equal length. Axle 24 nests in and against portion 26*c* when cartridge 18 is installed for operation. Axle 24 simultaneously abuts forward wall 20*a* to provide full control of axle 24. When cartridge 18 is removed, axle 24 is free to move up and rearward into and against a curved hole area portion 26*d* (between points C and D). In so moving, axle 24 travels horizontally to distance d. Areas 26*a* are slightly larger than the cross-sectional area of cross pin axle 24 to reduce frictional engagement of axle 24 and holes 26 when cartridge 18 is removed. Thus, the forces of inserted cartridge 18 hold sheath 21 in fixed position against walls 20*a* providing sheath 21 control by upper and lower axles 21*a*, 24, respectively.

Sheath upper axle rod 21*a* is housed firmly in a cross passageway (not shown) in head 17. The stability of sheath 21 provides a constant space between front face 17*f* of head 17 and inner surface 22*s* of sheath front panel 22*a* where staple driving blade 13 reciprocates (see FIG. 4). The firm control of sheath 21 during the stapling operation reduces jamming of staples.

Figure 6:
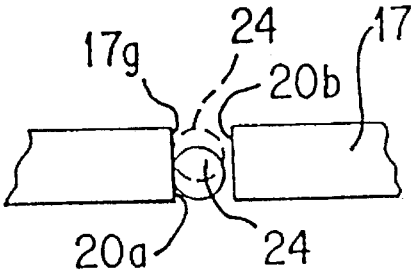
FIG. 6 is a view taken long line 6—6 of FIG. 2.

If a jam does occur, cartridge 18 is removed allowing spring fingers 33*a*, 33*b* of spring 31 to urge axle 24 upwardly in holes 26 and in head grooves 17*g* (FIG. 6). Each groove 17*g* has a forward wall 20*a* and a rearward wall 20*b* which walls 20*a*, 20*b* are spaced apart a distance greater than the diameter of axle 24 to reduce frictional engagement. Pin 24 is shown in its raised released position in dotted lines in FIG. 6. Sheath 21 is then capable of swinging a few degrees about fixed axle 21*a* in direction (arrow B of FIG. 5) to allow jammed staple s to drop down.

I claim:

1. A cartridge stapler having a base, a head, a head axle, slots in said head, a staple blank cartridge removably connected to the head and a sheath with spaced-apart panels mounted for turning about such head axle, the improvement comprising:

1) a second axle having an axis extending through configured holes in the side panels of the sheath, said second axle including said axis being displaceable between an operable position and a released position;

2) spring means for urging the second axle towards its released position; and 3) releasable control means including said cartridge and said slots in the head for holding such second axle stationary in its operable position when said cartridge is connected to the head and for releasing the second axle from its operable position when said cartridge is removed from the head, said cartridge engaging the second axle and holding the second axle in its operable position when said cartridge is connected to the head.

2. The stapler of claim 1, wherein each configured hole has a lower area for accommodating the second axle in its operable position and an upper area for accommodating the second axle in its released position.

3. A cartridge stapler having a base, a head, a head axle, slots in said head, a cartridge for staple blanks and a sheath with spaced-apart panels mounted for turning about such head axle, the improvement comprising:

1) second axle extending through configured holes in the side panels of the sheath;

2) spring means urging the second axle upwardly; and 3) releasable control means including said cartridge and said slots in the head for holding such second axle stationary during stapler operation, wherein the cartridge includes a bottom surface positioned against said second axle and in which releasable latch means on the head holds the cartridge bottom against relative movement with the head during normal operation.

4. The cartridge of claim 3, the latch means includes a) ridge means on the bottom of the cartridge; and b) pivotal resilient lever means engageable with said ridge means.

5. A cartridge stapler having a base, a head, a head axle, slots in said head, a cartridge for staple blanks and a sheath with spaced-apart panels mounted for turning about such head axle, the improvement comprising:

1) a second axle extending through configured holes in the side panels of the sheath;

2) spring means urging the second axle upwardly;

3) releasable control means including said cartridge and said slots in the head for holding such second axle stationary during stapler operation;

4) each configured hole having a lower and an upper area each for accomodating the second axle; and 5) said cartridge engaging the second axle to move the second axle into the lower areas of the holes.

* * * * *